US006920735B1

(12) United States Patent
Lambert et al.

(10) Patent No.: US 6,920,735 B1
(45) Date of Patent: Jul. 26, 2005

(54) BLOCK POSITIONING TOOL

(76) Inventors: Vester L. Lambert, 317 7th St., P.O. Box 878, Hampton, AR (US) 71744; Helene D. Lambert, 317 7th St., P.O. Box 878, Hampton, AR (US) 71744

( * ) Notice: Subject to any disclaimer, the term of this patent is extended or adjusted under 35 U.S.C. 154(b) by 0 days.

(21) Appl. No.: 10/683,993

(22) Filed: Oct. 14, 2003

(51) Int. Cl.[7] ..... E04D 15/00

(52) U.S. Cl. ..... 52/749.13; 33/474; 33/476; 33/405; 33/613; 33/645; 33/562; 33/418; 33/427; 33/429

(58) Field of Search ..... 33/474, 476, 405, 33/613, 645, 562, 418, 427, 429; 52/749.13

(56) References Cited

U.S. PATENT DOCUMENTS 1,916,638 A * 7/1933 Rizianu ..... 33/418
2,966,080 A 12/1960 Alots
4,513,510 A * 4/1985 Swanson ..... 33/419
4,697,351 A * 10/1987 Hopfer ..... 33/420
4,955,141 A * 9/1990 Welch ..... 33/418
5,491,905 A 2/1996 Jablonski et al.
5,813,126 A 9/1998 Dahl
5,937,613 A 8/1999 Vess, Sr.
6,105,266 A * 8/2000 Cote ..... 33/451
6,494,015 B1 12/2002 Critchlow

* cited by examiner

*Primary Examiner*—Brian E. Glessner
*Assistant Examiner*—Steve Varner

(57) ABSTRACT

A block positioning tool includes a first elongated member and a second elongated member attached together such that a L-shaped frame is formed. The frame has an upper surface and a bottom surface. The first and second elongated members each have a slot therein extending through the upper and bottom surfaces. Each of the first and second elongated members has an associated attached end and a free end. A plurality of position indicators is attached to and selectively moveable along a length of the slots. A primary anchor is attached to a bottom surface of the attached end. Each of a plurality of secondary anchors is attached to one of the position indicators and positioned adjacent to the bottom surface. Each of the secondary anchors and the primary anchor is removably positionable into depressions extending into an upper surface of pier blocks.

8 Claims, 5 Drawing Sheets

BLOCK POSITIONING TOOL

BACKGROUND OF THE INVENTION

1. Field of the Invention

The present invention relates to positioning devices and more particularly pertains to a new positioning device for aiding in the positioning of pier blocks in a uniform spatial pattern.

2. Description of the Prior Art

The use of positioning devices, particularly those for constructing decks, is known in the prior art. U.S. Pat. No. 6,949,015 describes a device for the spacing and positioning of vertical pickets. Another type of positioning device is U.S. Pat. No. 5,937,613 for aligning studs.

While these devices fulfill their respective, particular objectives and requirements, the need remains for a device for aligning pier blocks along straight lines and in such a manner that they are precisely spaced from each other.

SUMMARY OF THE INVENTION

The present invention meets the needs presented above by generally comprising a first elongated member and a second elongated member attached together in a generally perpendicular relationship with respect to each other such that a L-shaped frame is formed. The frame has an upper surface and a bottom surface. The first elongated member has a slot therein extending through the upper and bottom surfaces. The second elongated member has a slot therein extending through the upper and bottom surfaces. Each of the first and second elongated members has an associated attached end and a free end. A plurality of position indicators is attached to and selectively moveable along a length of the slots of one of the first and second elongate members. A primary anchor is attached to a bottom surface of the attached end. Each of a plurality of secondary anchors is attached to one of the position indicators and positioned adjacent to the bottom surface. Each of the secondary anchors and the primary anchor is removably positionable into depressions extending into an upper surface of pier blocks.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
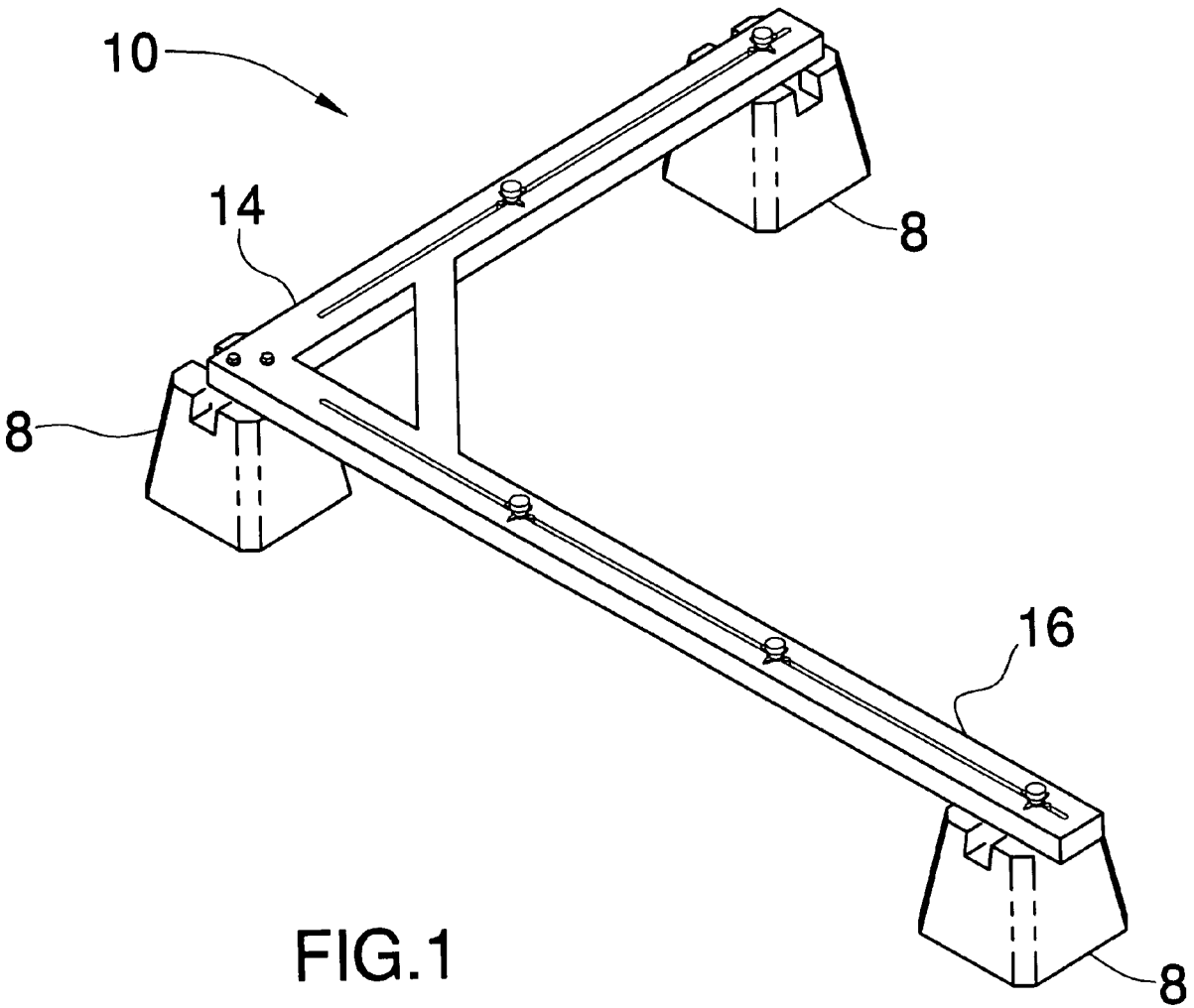
FIG. 1 is a schematic perspective view of a block positioning tool according to the present invention.
Figure 2:
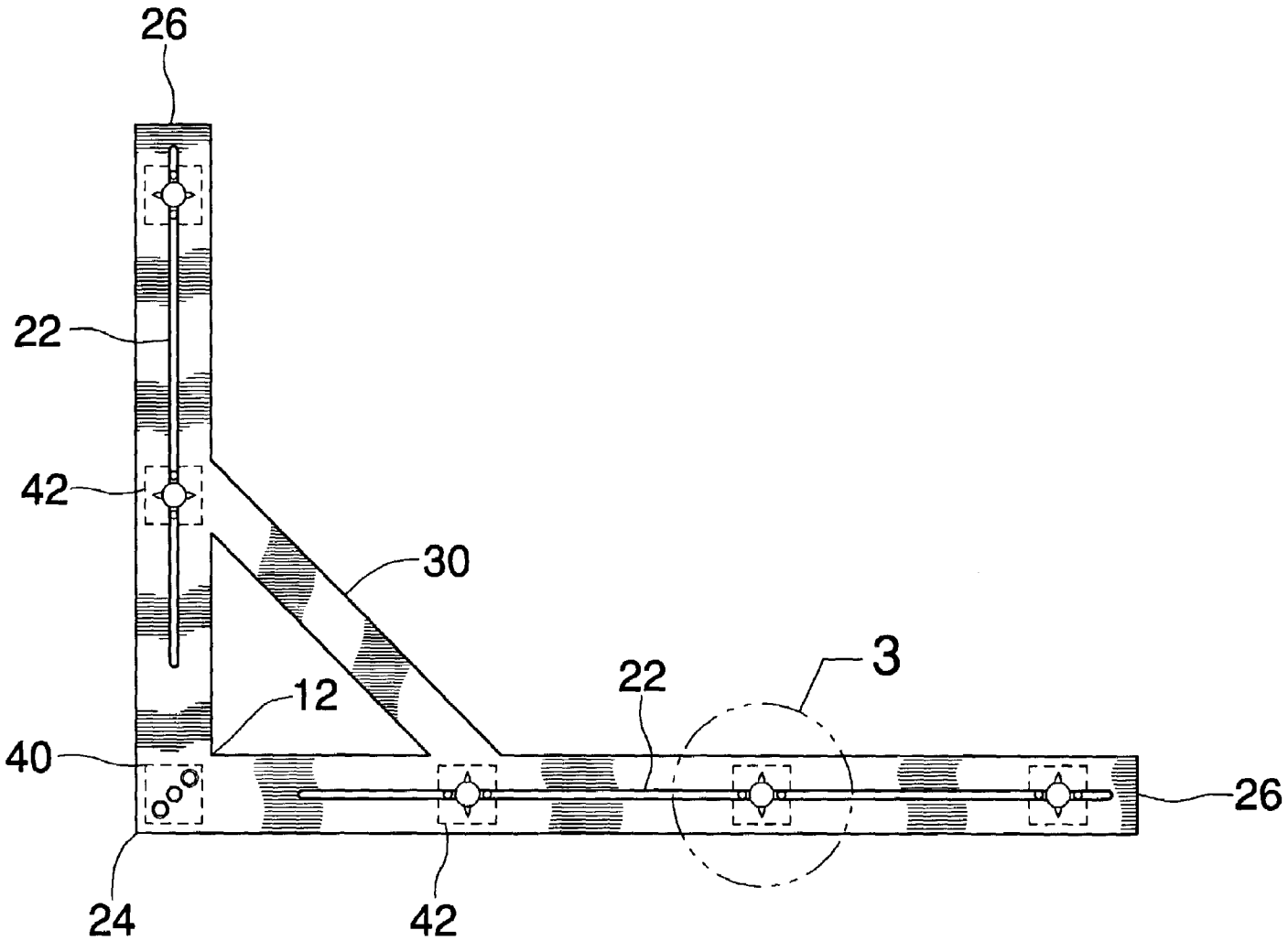
FIG. 2 is a schematic top view of the present invention.
Figure 3:
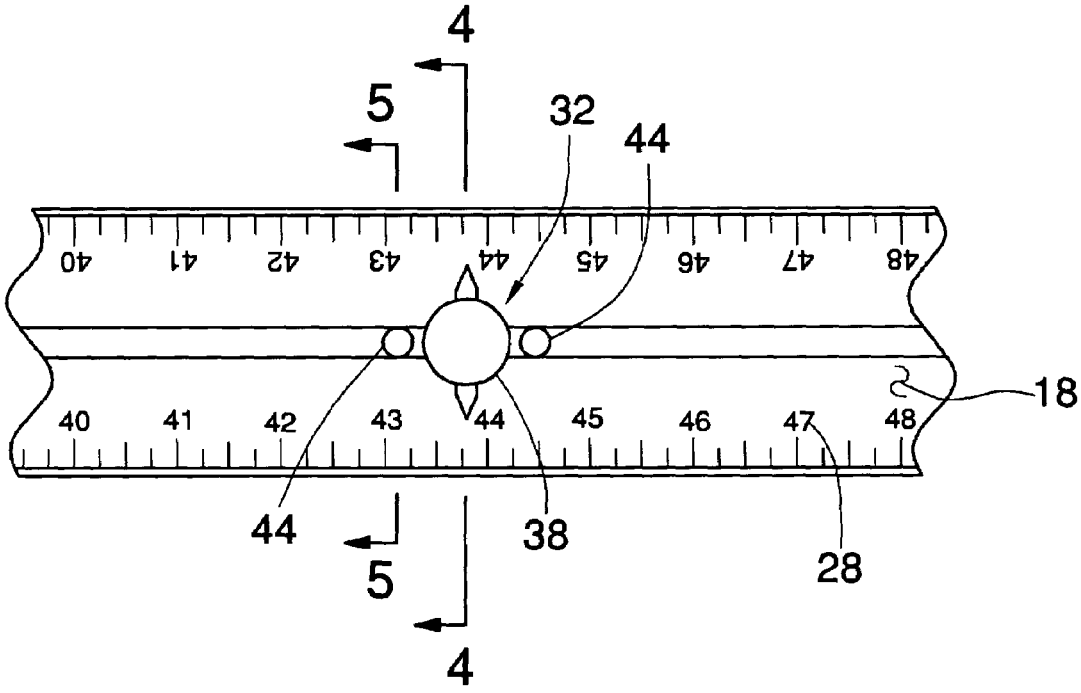
FIG. 3 is a schematic enlarged view of the present invention.
Figure 4:
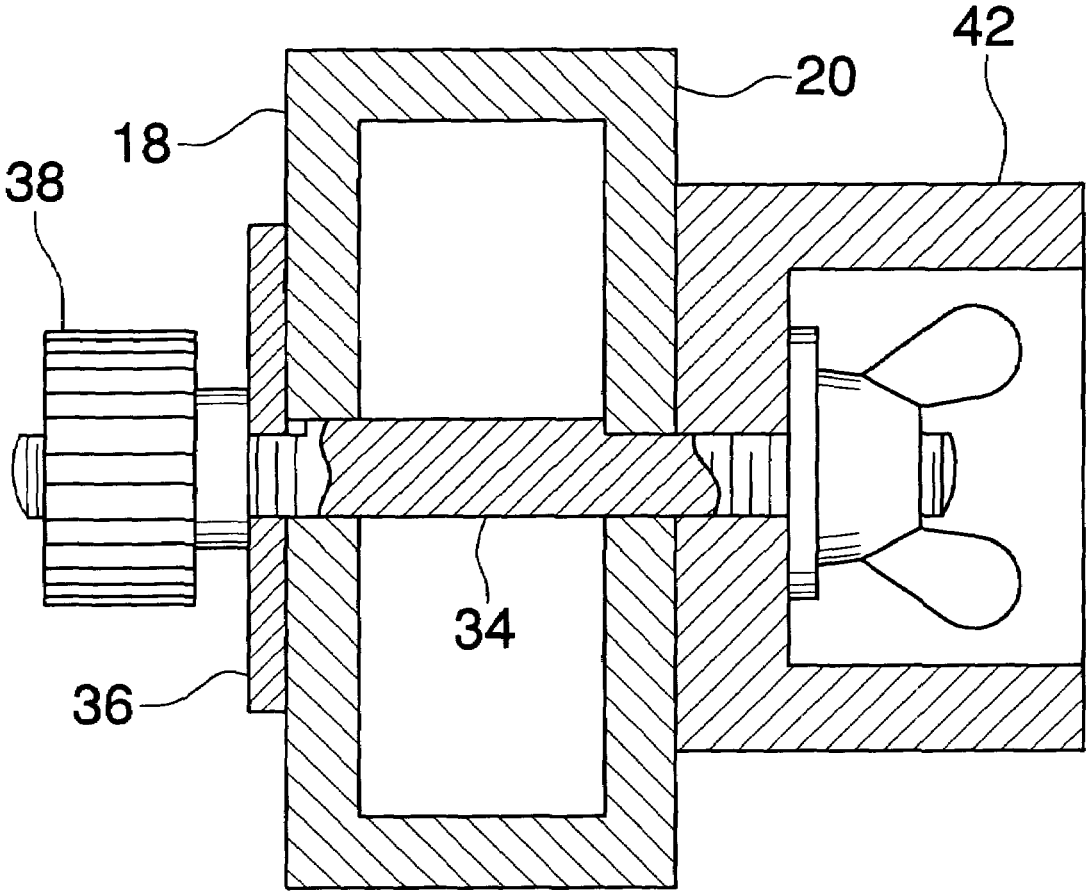
FIG. 4 is a schematic cross-sectional view taken along line 4—4 of FIG. 3 of the present invention.
Figure 5:
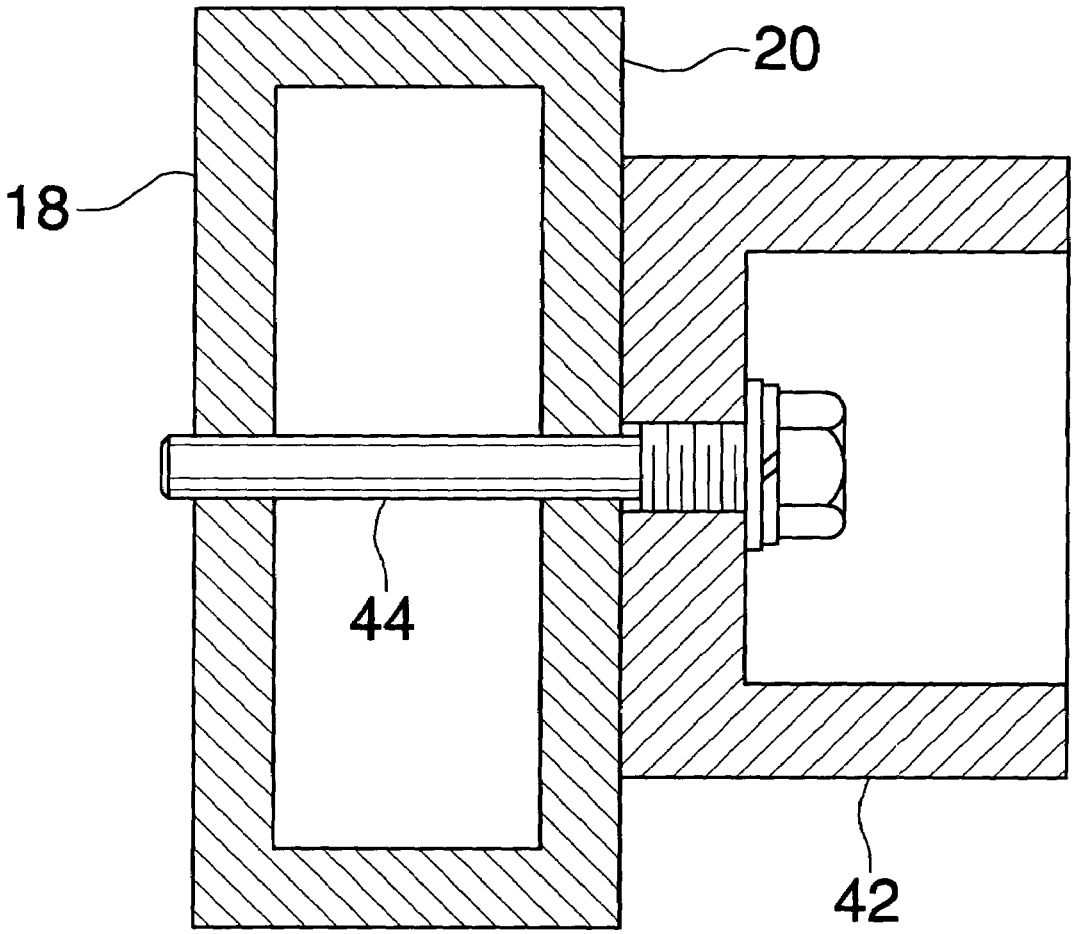
FIG. 5 is a schematic cross-sectional view taken along line 5—5 of FIG. 3 of the present invention.

With reference now to the drawings, and in particular to FIGS. 1 through 5 thereof, a new positioning device embodying the principles and concepts of the present invention and generally designated by the reference numeral 10 will be described.

As best illustrated in FIGS. 1 through 5, the block positioning tool 10 generally comprises a first elongated member 14 and a second elongated member 16 attached together in a generally perpendicular relationship with respect to each other such that a L-shaped frame 12 is formed. The frame 12 has an upper surface 18 and a bottom surface 20. The first elongated member 14 has a slot 22 therein extending through the upper 18 and bottom 20 surfaces and the second elongated member 16 also has a slot 22 therein extending through the upper 18 and bottom 20 surfaces. Each of the first 14 and second 16 elongated members has an associated attached end 24 and a free end 26. The upper surfaces 18 of each of the first 14 and second 16 elongated members have measurement indicia 28 thereon from the attached end 24 to the free ends 26. The first elongated member 14 generally measures between 2.5 feet and 3.5 feet and the second elongated member 16 generally measuring between 3.5 feet and 4.5 feet. A brace 30 is attached to an extended between the first 14 and second 16 elongated members.

A plurality of position indicators 32 is attached to and each is selectively moveable along a length of one of the first 14 and second 16 elongate members. Each of the indicators 32 includes a threaded rod 34 that extends through one of the slots 22. A marker 36 is mounted on each of the rods 34 and is positioned on the upper surface 18. A securing knob 38 is threadably coupled to each of the rods 34 and positioned above the upper surface 18 for selectively securing the rods 34 in a fixed position. It is preferred that at least one position indicator is positioned on each of the first 14 and second 16 elongated members.

A primary anchor 40 is attached to a bottom surface 20 of the attached end 24. Each of a plurality of secondary anchors 42 is attached to one of the position indicators 32 and positioned adjacent to the bottom surface 20. The anchors 40, 42 are positionable in depressions located in an upper surface of pier blocks 8. Each of the secondary anchors 42 is removably attached to a bottom end of one of the rods 34. Each of the primary 40 and secondary 42 anchors is generally four inches long and four inches wide. A plurality of stabilizers 44 extends through the slots and each is removably attached to one of the secondary anchors 42. Preferably, a pair of the stabilizers 44 is removably attached to each of the secondary anchors 42. The stabilizers 44 prevent the secondary anchors 42 from rotating with respect to the frame 12 when the rod 34 is tightened.

In use, the tool 10 is used for determining the positioning of pier blocks 8 as they are positioned. Specifically, the tool is designed for the positioning of Dek-Block pier blocks, information on which can be found at www.dekbrands.com/block.html. The tool 10 enables a person to selectively position these pier blocks 8 in a spaced relationship with respect to each in a uniform manner. The secondary anchors 42 are positioned where desired on the frame 12 and secured in place. The primary anchor 40 is placed in a first pier block and additional pier blocks are positioned so that the secondary anchors 42 may be set into the additional pier blocks. Additional pier blocks are then added by positioning the primary anchor into the added pier blocks and so on until an evenly spaced matrix of pier blocks is formed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A block placement tool for setting pier blocks, the pier blocks having an upper side having a depression therein, said tool comprising:

a first elongated member and a second elongated member attached together in a generally perpendicular relationship with respect to each other such that a L-shaped frame is formed, said frame having an upper surface and a bottom surface, said first elongated member having a slot therein extending through said upper and bottom surfaces, said second elongated member having a slot therein extending through said upper and bottom surfaces, each of said first and second elongated members having an associated attached end and a free end;

a plurality of position indicators being attached to and selectively moveable along a length of the slots of one of said first and second elongate members, each of said indicators including;

a threaded rod extending through one of said slots;

a marker being mounted on said rod and positioned on said upper surface;

a securing knob being threadably coupled to said rod and positioned above said upper surface for selectively securing said rod in a fixed position;

a primary anchor being attached to a bottom surface of the attached end; and a plurality of secondary anchors, each of said secondary anchors being attached to one of said position indicators and positioned adjacent to said bottom surface, each of said secondary anchors and said primary anchor being removably positionable into one of the depressions, each of said secondary anchors being removably attached to a bottom end of one of said rods.

2. The tool of claim 1, wherein said upper surfaces of each of said first and second elongated members have measurement indicia thereon from said attached end to said free ends.

3. The tool of claim 2, wherein said first elongated member generally measures between 2.5 feet and 3.5 feet, said second elongated member generally measuring between 3.5 feet and 4.5 feet.

4. The tool of claim 1, wherein said first elongated member generally measures between 2.5 feet and 3.5 feet, said second elongated member generally measuring between 3.5 feet and 4.5 feet.

5. The tool of claim 1, further including a brace being attached to an extending between said first and second elongated members.

6. The tool of claim 1, wherein each of said secondary anchors is generally four inches long and four inches wide.

7. The tool of claim 1, further including a plurality of stabilizers extending through said slots and being removably attached to one of said secondary anchors, wherein a pair of said stabilizers being removably attached to each of said secondary anchors.

8. A block placement tool for setting pier blocks, the pier blocks having an upper side having a depression therein, said tool comprising:

a first elongated member and a second elongated member attached together in a generally perpendicular relationship with respect to each other such that a L-shaped frame is formed, said frame having an upper surface and a bottom surface, said first elongated member having a slot therein extending through said upper and bottom surfaces, said second elongated member having a slot therein extending through said upper and bottom surfaces, each of said first and second elongated members having an associated attached end and a free end, said upper surfaces of each of said first and second elongated members having measurement indicia thereon from said attached end to said free ends, said first elongated member generally measuring between 2.5 feet and 3.5 feet, said second elongated member generally measuring between 3.5 feet and 4.5 feet;

a brace being attached to an extending between said first and second elongated members;

a plurality of position indicators being attached to and selectively moveable along a length of one of said first and second elongate members, each of said indicators including:

a threaded rod extending through one of said slots;

a marker being mounted on said rod and positioned on said upper surface;

a securing knob being threadably coupled to said rod and positioned above said upper surface for selectively securing said rod in a fixed position;

a primary anchor being attached to a bottom surface of the attached end;

a plurality of secondary anchors, each of said secondary anchors being attached to one of said position indicators and positioned adjacent to said bottom surface, each of said secondary anchors being removably attached to a bottom end of one of said rods, each of said secondary anchors being removably positionable into one of the depressions, each of said secondary anchors and said primary anchor being generally four inches long and four inches wide; and a plurality of stabilizers extending through said slots and being removably attached to one of said secondary anchors, wherein a pair of said stabilizers being removably attached to each of said secondary anchors.

* * * * *